US008510982B1

(12) United States Patent
Squires

(10) Patent No.: US 8,510,982 B1
(45) Date of Patent: Aug. 20, 2013

(54) INTERNAL LIGHT FOR HAND GUN

(76) Inventor: William Squires, Idaho Falls, ID (US)

( * ) Notice: Subject to any disclaimer, the term of this patent is extended or adjusted under 35 U.S.C. 154(b) by 72 days.

(21) Appl. No.: 13/396,076

(22) Filed: Feb. 14, 2012

(51) Int. Cl.
*F41G 1/00* (2006.01)

(52) U.S. Cl.
USPC ..... 42/146; 42/131; 42/123; 42/113; 42/114; 42/115; 42/117

(58) Field of Classification Search
USPC ..... 42/146, 131, 123, 113, 114, 115, 42/117
See application file for complete search history.

(56) References Cited

U.S. PATENT DOCUMENTS

| | | | | |
|---|---|---|---|---|
| 4,934,086 | A * | 6/1990 | Houde-Walter | 42/115 |
| 5,392,550 | A * | 2/1995 | Moore et al. | 42/117 |
| 5,419,072 | A * | 5/1995 | Moore et al. | 42/117 |
| 5,531,040 | A * | 7/1996 | Moore | 42/115 |
| 2005/0252061 | A1 * | 11/2005 | Sloan et al. | 42/114 |
| 2011/0252681 | A1 * | 10/2011 | Houde-Walter et al. | 42/1.01 |

* cited by examiner

*Primary Examiner* — J. Woodow Eldred
(74) *Attorney, Agent, or Firm* — Robert L. Shaver; Dykas & Shaver

(57) ABSTRACT

Disclosed is a light assembly for placement inside a handgun, with the battery of the light assembly replacing the recoil spring guide of the handgun. The recoil spring of the handgun fits over the battery of the disclosed lighting assembly. The light provides a primary or alternative light source for the user of a handgun, and may provide white light or infrared light. The light assembly disclosed may be mounted inside a handgun without making permanent modifications to the handgun.

10 Claims, 3 Drawing Sheets

INTERNAL LIGHT FOR HAND GUN

TECHNICAL FIELD

The presently disclosed and claimed inventive concept(s) generally relate to a light for handguns and more particularly to an LED or infrared light which is installed on the inside of a handgun and which replaces the recoil spring guide rod.

BACKGROUND

Law enforcement officers, military officers, and citizens alike have relied on the handgun for personal protection and the defense of others. Due to the varying light and weather conditions that might be encountered when deploying these pistols, the need for a readily available light source has become common place.

Over the last 15-20 years, the separate handheld flashlight has given way to weapon mounted flashlights. To accommodate them, firearm manufacturers began to integrate what are known as accessory "rails" into the frames of their pistols. This allows flashlights, lasers, and other accessories to be attached to the firearm itself.

Although this is an improvement to having a separate unattached flashlight, there are some inherent problems associated with these weapon lights. These problems include added size and weight to the pistol. When holding a gun at arm's length, every ounce counts. The irregular shape adds bulk and more importantly necessitates the use of specially designed holsters to accommodate the pistol with the light attached.

SUMMARY

The disclosed technology is a light source which is mounted inside the semiautomatic handgun, and in which most of the components related to the light are internally mounted within the firearm. It integrates the light source into the location normally utilized by the recoil spring guide and uses an activation switch using a push-on push off switch, a rotating switch, a rotating lever switch, a proximity switch, a touch pad switch, or other switches. It may also use either the takedown lever or slide release lever for the activation switch. This light source would preferably be an LED, or an infrared light source. It could use a standard parabolic reflector, or could use a plastic cone utilizing the principle of total internal reflectance. This light could be built into the handgun in the factory, or added to a handgun as an aftermarket product. By substituting the parts of the light unit with parts already in the pistol, the light unit of the invention will add minimal weight to the pistol. Even more importantly, by being substantially internal, there is no change to the critical outside dimensions of the pistol. This negates the need for special holsters.

Another important point is that it doesn't interfere with the use of the other traditional weapon lights mounted on the accessory rail or to the front of the trigger guard. So, if the consumer chooses, they can use both lights to increase light output or one as a redundant backup for the other, or have a laser sight on the rail, combined with a white or infrared light from the internally mounted light. In the law enforcement and military world there is great emphasis placed on having backup resources in place. This idea is very valuable in that regard.

The disclosed integral light could also be used as an Infrared (IR) light source for use with night vision equipment with addition of an IR filter in the lens. Another use for the disclosed technology device is as a punching or glass breaking tool. The end of the lens will be knurled in such a way that it can be used to punch with and still protect the lens assembly and keep the pistol in battery and ready to fire.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DETAILED DESCRIPTION OF THE EXEMPLARY EMBODIMENTS

Figure 1:
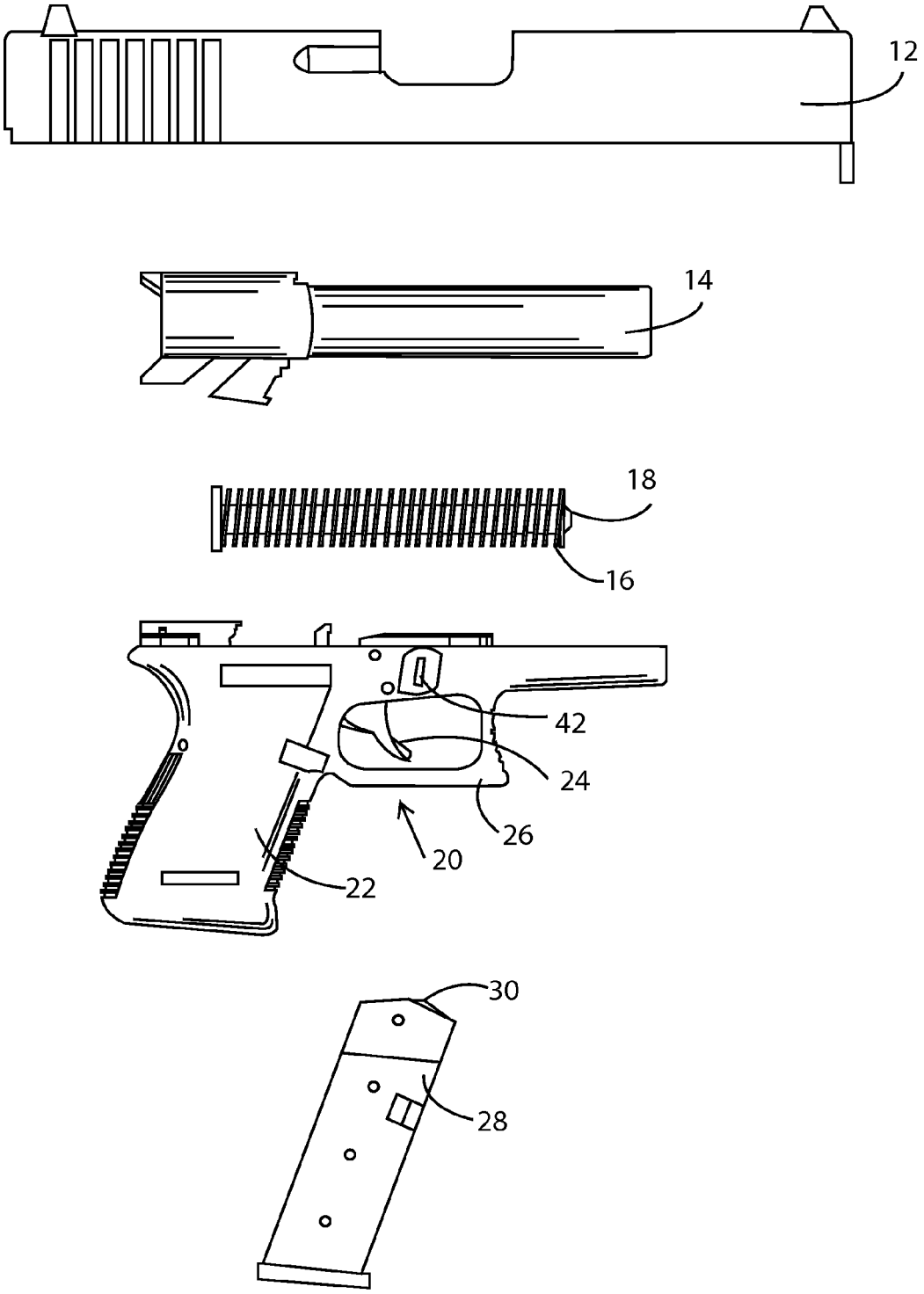
FIG. 1 is an exploded side view of a typical handgun.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

Every semi-automatic pistol uses a recoil spring to return the weapon into "battery" when it is fired. The spring surrounds a spring guide which keeps the spring straight in the handgun. This spring guide and spring are typically mounted underneath and parallel with the barrel. There is a hole in the barrel end of the slide to allow the spring guide to protrude when the slide is retracted. The figures show the typical location of the spring guide and spring in a semi-automatic pistol that's been partially disassembled.

The spring guide hole in the front of the slide is directly underneath the hole for the barrel. The disclosed device would replace the spring guide itself with a new assembly that would contain the battery as well as act as a recoil spring guide. It would also be operatively connected to an activation switch of the types noted above, or utilizing other switches. The new assembly would be longer than the stock spring guide and be threaded on the end, with the treaded portion extending through the recoil spring guide hole on the front of the slide. A lock ring would secure the battery pack of the invention to the slide, and the reflector assembly would screw on the threads of the end of the battery pack extending through the recoil spring guide hole in the slide. The reflector assembly could also attach to the replacement recoil spring guide by a quick release attachment, such as a partial twist on, a bayonet mount, or a quick release similar to fittings used on pneumatic hoses and fittings that connect to those. After the pistol is assembled with the new guide assembly, the lens, bulb, and reflector assembly would then be threaded on the end of the spring guide on the outside of the slide.

The components of the device could be made in different materials (i.e. plastic, aluminum, titanium, etc.) and it can be made to match different firearm finishes (i.e. chrome, blued, stainless, etc.)

Shown in FIG. 1 are the typical components of an automatic handgun. Shown is a slide 12, a barrel 14, a recoil spring 16 which surrounds a recoil spring guide 18. All of these components fit into the frame 20 which includes a handle 22, a trigger 24, and a trigger guard 26. Also shown is a magazine 28 which fits inside the handle 22 and holds a number of bullets which are delivered to the firing assembly by a magazine follower 30. When a bullet is fired, the recoil from the bullet pushes the slide 12 back on the frame 22. The slide 12 compresses the recoil spring 16, and the recoil spring pushes the slide 12 back into position for firing another cycle.

Figure 2:
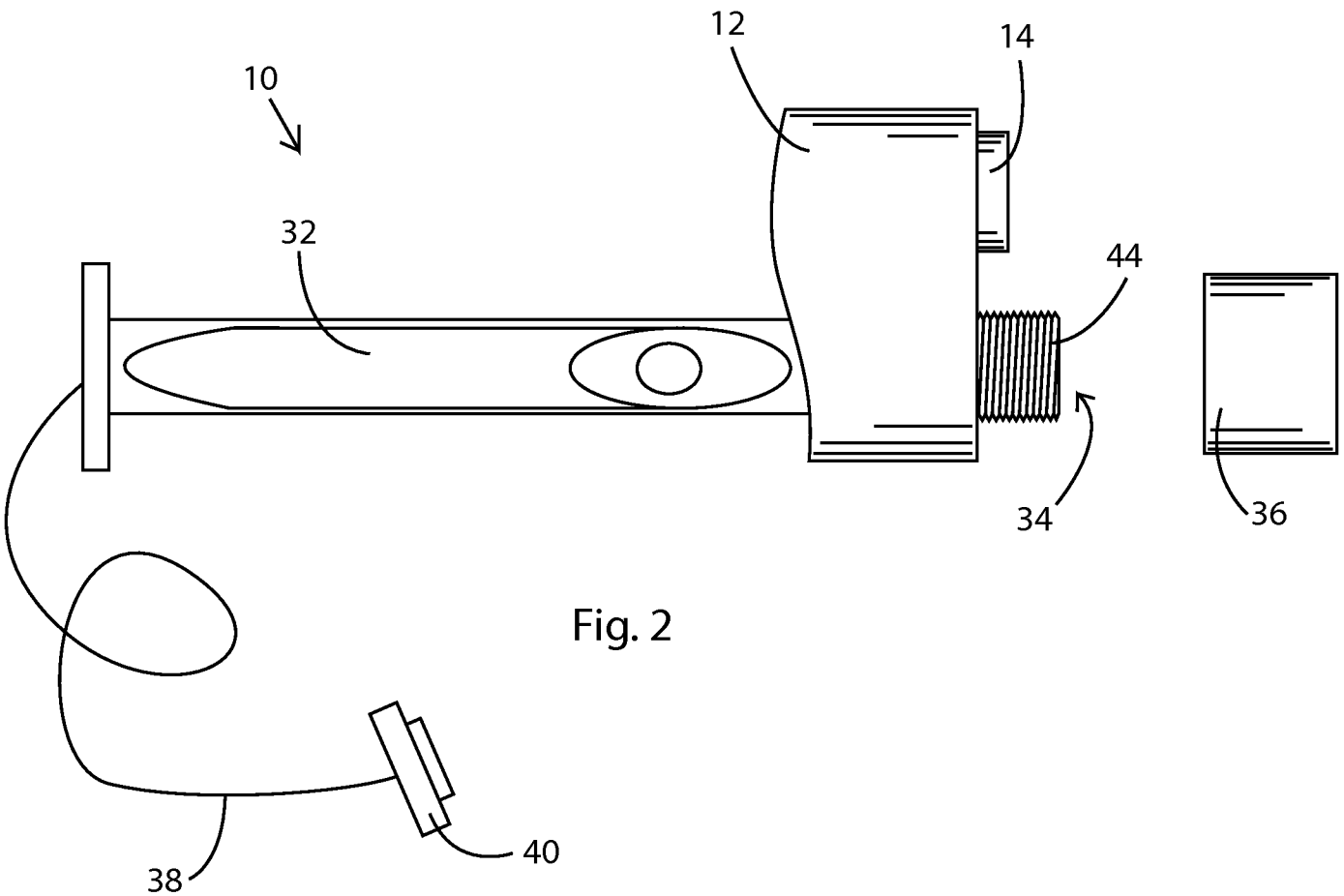
FIG. 2 is a view of components of the disclosed technology.

FIG. 2 shows the components of the disclosed technology which fit inside the handgun and replace parts of the internal workings of the handgun. Shown in FIG. 2 is a battery 32 which replaces the recoil spring guide 18. The recoil spring is not shown, but would be mounted outside of the battery 32 in the same manner as the recoil spring 16 surrounds the recoil spring guide 18. Mounted adjacent to the battery 32 is an LED light 34. The end of the LED light 34 could be flush with the frame or could extend outside the frame. Shown in FIG. 2 is part of the slide 12 of the handgun, showing the end of the barrel 14 extending out from the end of the slide 12. An optional feature is a lens 36 which would go outside the LED light 34 and could provide a reflector or optic for directing the light from the LED. Shown at one end of the battery 32 is an electrical connection 38 which would go to a switch 40. The switch 40 can be configured with a part of the switch external to the firearm and could replace the slide takedown switch. An example of a slide takedown switch is shown in FIG. 1 as 42. The switch could be mounted in other places of the gun, such as inside the trigger guard or in front of the trigger guard. Shown in FIG. 2 are threads 44 which extend outside the frame 12 of the handgun and are provided for mounting the lens or reflector 36. Alternatively, the light source can extend outside the weapon frame. An important feature of this design is that it does not interfere with other devices which are attached to the weapon using accessory rails, and it may be holstered in a conventional holster. It can be produced in a variety of finishes to match different firearms. An advantage of this design is that no permanent modifications need be made to the firearm. The spill and the throw of the light may also be adjusted, such as by turning the reflector assembly 36.

The device can be activated by a button, pressure pad, by twisting the lens, or other conventional switch means. The device can have the ability to adjust the level of brightness and switch to effect such as strobe or disorientation flashing.

The programming option for brightness level and strobe we could also have an automatic turn off feature in case the light is turned on inadvertently.

Figure 3:
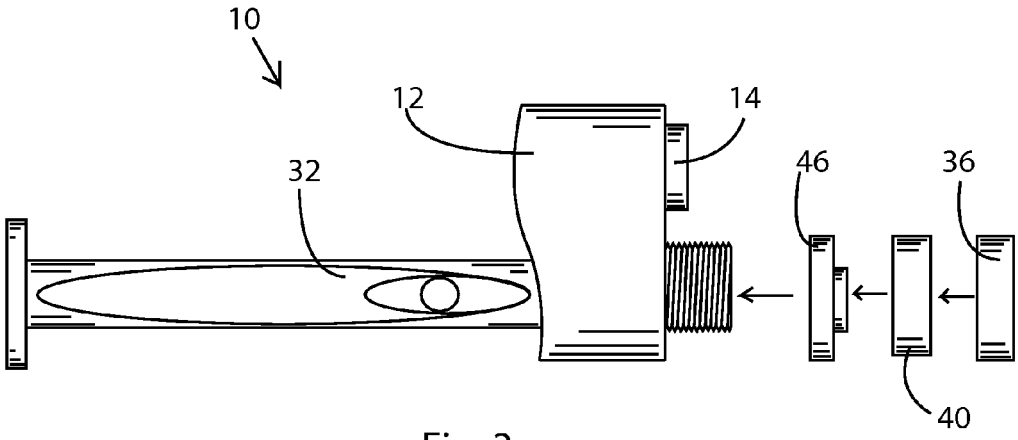
FIG. 3 is a side view of one version of the light assembly.
Figure 4:
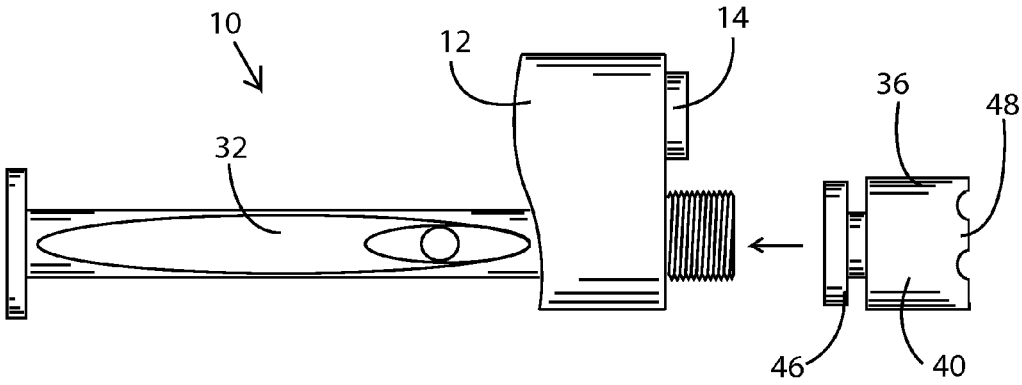
FIG. 4 is a version of the flashlight with a castled end cap.

FIGS. 3 and 4 show alternative versions of the light in which the assembly which include a locking ring 46, which may include a switch 40 built into the reflector assembly 36, or adjacent to the reflector assembly. The reflector assembly in FIG. 4 has a castellated end which is useful for striking, such as for breaking glass. The locking ring 46 can also serve as a switch which operates by turning, and the reflector assembly 36 can also serve as a switch which activates by turning.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

I claim:

1. A handgun light for a semiautomatic handgun of the type having a barrel, a trigger, a frame, a slide with a front face having a barrel hole and a recoil spring guide hole, with each hole corresponding to the diameter of the barrel and a recoil spring guide, said pistol light comprising:

a generally cylindrical recoil spring guide comprising a battery pack, for placement in said handgun slide behind said slide front end and below said barrel of said handgun, with a threaded first end adapted to extend through said recoil spring guide hole and beyond the front of the slide;

an internally threaded lock ring for threaded connection to said first end of said recoil spring guide, with said lock ring for securing said recoil spring guide to said slide front face; and an internally threaded reflector assembly adapted for threaded connection to said first end of said recoil spring guide, comprising a reflector casing, a light source, a reflector, and a switch for activating or deactivating said light source.

2. The handgun light of claim 1 in which said switch is a push on push off switch, in which case the reflector assembly is pushed toward the front end of the slide to activate or deactivate the light source.

3. The handgun light of claim 1 in which said switch operates by a twist switch operationally connected to the reflector casing.

4. The handgun light of claim 1 in which said reflector assembly comprises a total internal reflectance lens.

5. The handgun light of claim 1 in which said reflector assembly comprises a parabolic reflector.

6. The handgun light of claim 1 in which said light source is an LED light source.

7. The handgun light of claim 1 in which said light source is an infrared light source.

8. The handgun light of claim 1 in which said reflector case comprises a front edge extending from said reflector assembly, with said front edge forming a striking or glass breaking tool.

9. The handgun light of claim 1 in which said light source has a strobe setting and can operate as a flashing strobe light.

10. A conversion kit for replacing a factory recoil spring guide in a handgun with an internally mounted light assembly, said kit comprising:

a generally cylindrical replacement recoil spring guide comprising a battery pack, for placement in said handgun in place of a factory recoil spring guide, in said handgun slide behind said slide front end and below said barrel of said handgun, with a threaded first end adapted to extend through said recoil spring guide hole and beyond the front of the slide;

an internally threaded lock ring for threaded connection to said first end of said replacement recoil spring guide, with said lock ring for securing said replacement recoil spring guide to said slide front face; and an internally threaded reflector assembly adapted for threaded connection to said first end of said replacement recoil spring guide, comprising a reflector casing, a light source, a reflector, and a switch for activating or deactivating said light source.

* * * * *